United States Patent [19]

Kawanami et al.

[11] 4,195,506

[45] Apr. 1, 1980

[54] METHOD AND APPARATUS FOR BENDING ELONGATED MATERIALS

[75] Inventors: Shunpei Kawanami, Hiratsuka; Susumu Hanyo, Yokohama, both of Japan

[73] Assignee: Daiichi Koshuha Kogyo Kabushiki Kaisha, Tokyo, Japan

[21] Appl. No.: 918,022

[22] Filed: Jun. 22, 1978

[30] Foreign Application Priority Data

Jun. 22, 1977 [JP] Japan ..... 52-73337
Mar. 31, 1978 [JP] Japan ..... 53-36576

[51] Int. Cl.[2] ..... B21D 7/16; B21D 7/12

[52] U.S. Cl. ..... 72/8; 72/13; 72/128; 72/306; 72/310; 72/369

[58] Field of Search ..... 72/8, 9, 11, 12, 13, 72/128, 149, 306, 308, 309, 310, 217, 342, 369, 388

[56] References Cited

U.S. PATENT DOCUMENTS

| | | | |
|---|---|---|---|
| 784,101 | 3/1905 | Brinkman | 72/128 |
| 785,083 | 3/1905 | Brinkman | 72/128 |
| 2,286,893 | 6/1942 | Boissou | 72/369 X |
| 3,958,438 | 5/1976 | Somov et al. | 72/128 |
| 4,056,960 | 11/1977 | Kawanami | 72/128 |
| 4,061,005 | 12/1977 | Kawanami et al. | 72/128 X |
| 4,062,216 | 12/1977 | Hanamoto et al. | 72/128 |
| 4,098,106 | 7/1978 | Yamaguchi | 72/128 |
| 4,122,697 | 10/1978 | Hanyo et al. | 72/128 |
| 4,151,732 | 5/1979 | Hofstede et al. | 72/8 |

*Primary Examiner*—Ervin M. Combs
*Attorney, Agent, or Firm*—L. Lawton Rogers, III

[57] ABSTRACT

The disclosure relates to a method of bending elongated materials such as pipe by applying a compressive primary bending force to the material at locations on either end of the portion of the material to be bent and locally stimulating bending of that portion of the material by the application of heat or a secondary bending force. The end portions of the materials are engaged by clamps, each clamp having an arm extending normal to the principle axis of the material. The compressive primary bend force is applied by exerting a force on locations on the arms displaced from the principal axis of the material, which force tends to draw the ends of the arms together.

38 Claims, 24 Drawing Figures

METHOD AND APPARATUS FOR BENDING ELONGATED MATERIALS

BACKGROUND OF THE INVENTION

This invention relates to method and apparatus for bending elongated materials.

Normally there are two kinds of methods for bending a elongated metal materials: cold and hot bending. Cold bending may be used when the relative bending radius, i.e. the ratio of bending radius to pipe diameter, is larger than about 18. The hot method is used for the smaller relative radius bending. However, in the making of high quality bent pipe, hot bending seems to be more widely used than would be warranted by the relative radius standard; for instance hot bending is often used up to a relative bending radius of 30. The ability to select whether cold or hot bending is to be performed is of value.

Accordingly, it is an object of the present invention to provide a method and apparatus which may be used in either cold or hot bending of an elongated metal material.

A known, portable cold press bender may be used as a field bender for large diameter pipes, but its size and weight is such that the bender is too cumbersome to be conveniently used.

It is another object of the present invention to provide a bender which is small and light and is useful not only in cold bending but also in hot bending of large size elongate metal material.

This invention relates to a metal bender method including the steps of clamping an elongated metal material with one clamp on one side of a portion of the material to be bent and clamping the material with another clamp on the other side of the portion of the material to be bent. An arm is provided transverse to the longitudinal axis of a clamp portion of the material. A device is provided, coupled to the transverse arms and coupled to the other clamp for exerting a force initially parallel to and displaced from a longitudinal axis of the portion of the material to be bent. The force applied tends to draw the clamped portions of the material together. At the same time, the portion of the material to be bent is acted upon by a device for stimulating bending locally, which device moves in a longitudinal direction along the elongated material.

Known field benders employ a press and dyes, and, therefore, require large, heavy, frames which must be strong enough to exert the required bending moment. The present invention eliminates such a frame and makes the apparatus very light and compact.

In the case of hot bending of a pipe with a heater employed as the bending stimulator, wall thinning of the pipe due to the bending is minimized over that obtained in a cold bending operation because of the compression applied on the pipe as taught by the present invention. However, this effect of preventing wall thinning may not be sufficient when the relative bending radius is small. The conventional alternative in such a case is to use pipe elbows welded into the piping. Of course such welded portions have the disadvantage that they may corrode. Moreover, in critical pipe uses such as in use in nuclear power plants, periodic non-destructive inspection is required for all welds. This sort of inspection is difficult and expensive to carry out particularly near bends. In the case of piping used in high temperature applications, welding of the alloy steel pipes is very expensive and requires special welding, X-ray inspection, and laborious heat treating. In the case of Austenite stainless steel piping for nuclear power plants, the cost of welding is very great and requires complicated procedures to prevent stress corrosion which is now experienced in many plants.

Accordingly, it is an object of the present invention to provide a bending method apparatus for bending pipes with a very small bending radius without thinning the pipe wall substantially or flattening the pipe cross section or causing any substantial metallurgical defect which would promote stress corrosion.

It is another object of the present invention to perform continuous uniform heat treating throughout the whole length of a pipe including not only a bent portion but also straight portions.

It is yet another object of the present invention to provide a compact and inexpensive universal bending apparatus for bending pipe to a very small radius.

It is yet another object of the present invention to provide a bending apparatus employing one short bending arm, which is suitable for bending small and large radius bends without resetting any mechanical parts of the bending apparatus.

These and other objects and features of the invention will become apparent from the claims and from the following description when read in conjunction with the accompanying drawings.

THE FIGURES

Figure 8A:
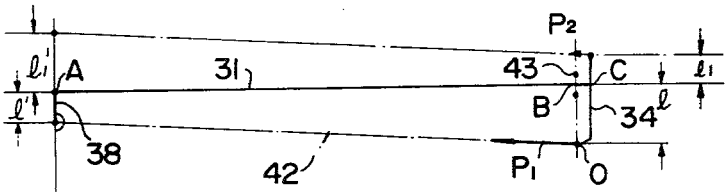

FIGS. 8A and B are diagrammatical views illustrating a method of maintaining pipe wall thickness constant.

Figure 9A:
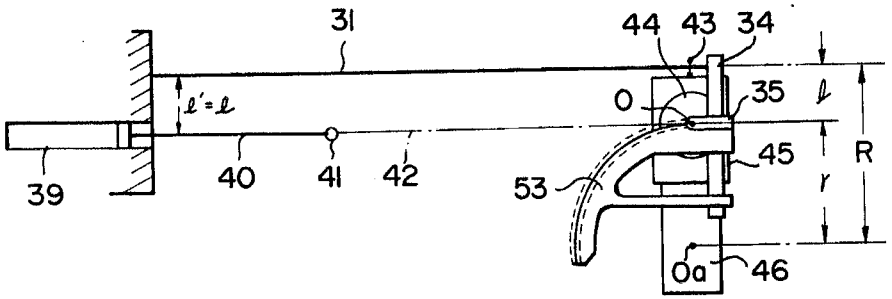

FIGS. 9A and B are schematic plan views of an alternate embodiment of the present invention, with a fan guide.

Figure 10A:
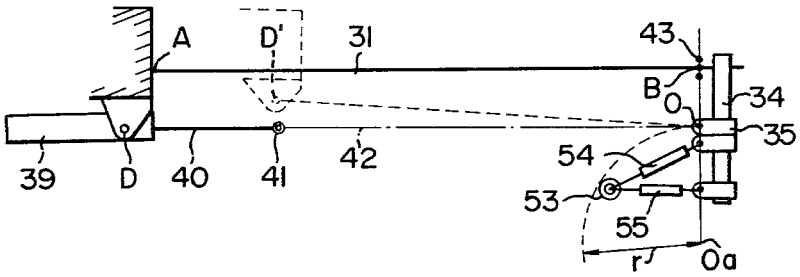

FIGS. 10A, B and C are schematic plan views of an alternate embodiment of the present invention with a single roller guide.

Figure 11:
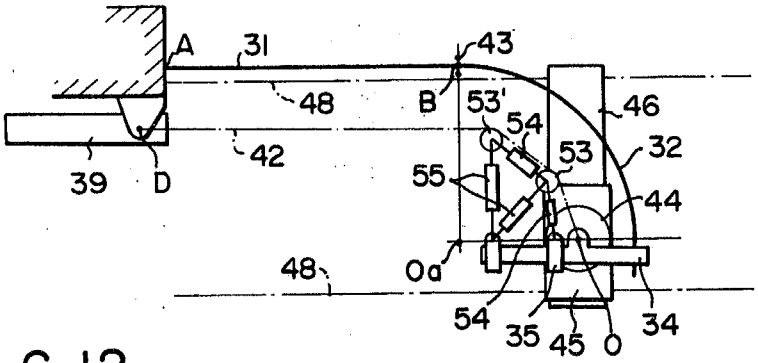

FIG. 11 is a schematic plan view of an alternate embodiment of the present invention with two roller guides.

Figure 12:
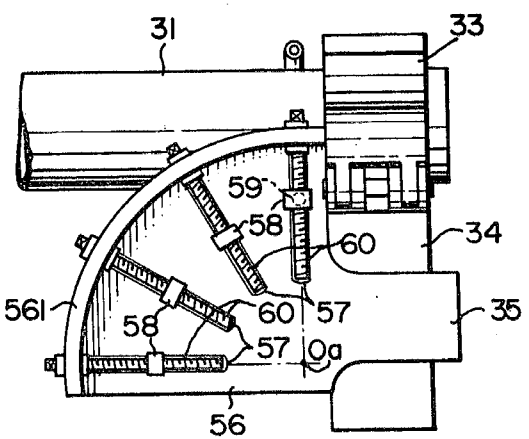

FIG. 12 is a plan view of a variable fan guide which may be substituted for the fan guide of the embodiment of the present invention shown in FIGS. 9A and B.

Figure 13:
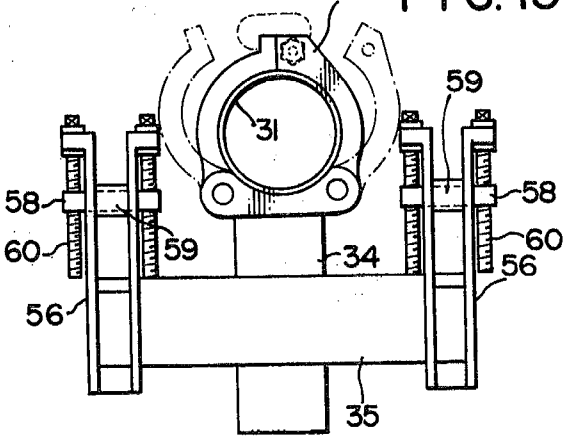

FIG. 13 is a front view of the fan guide of FIG. 12.

Figure 14:
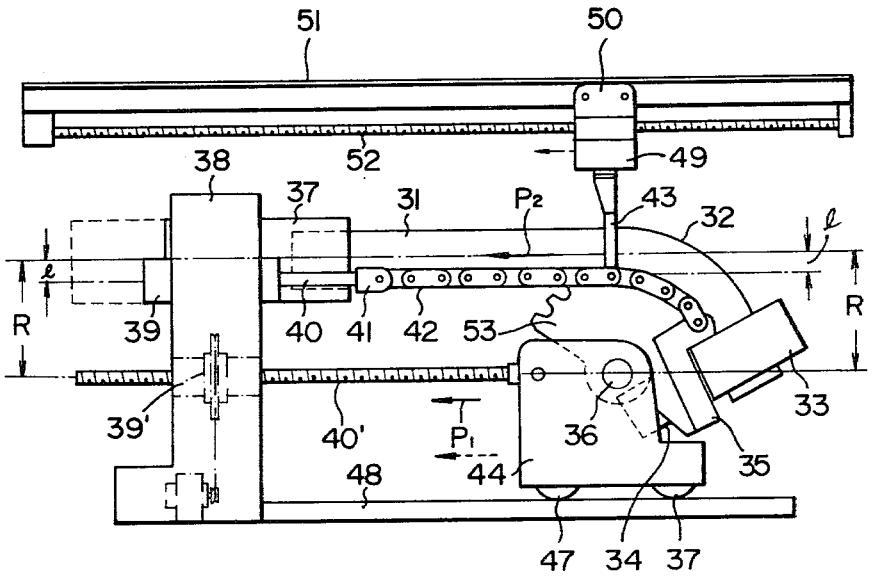

FIG. 14 is a side view of an embodiment of the present invention employing both a secondary pulling device and a fan guide.

Figure 15:
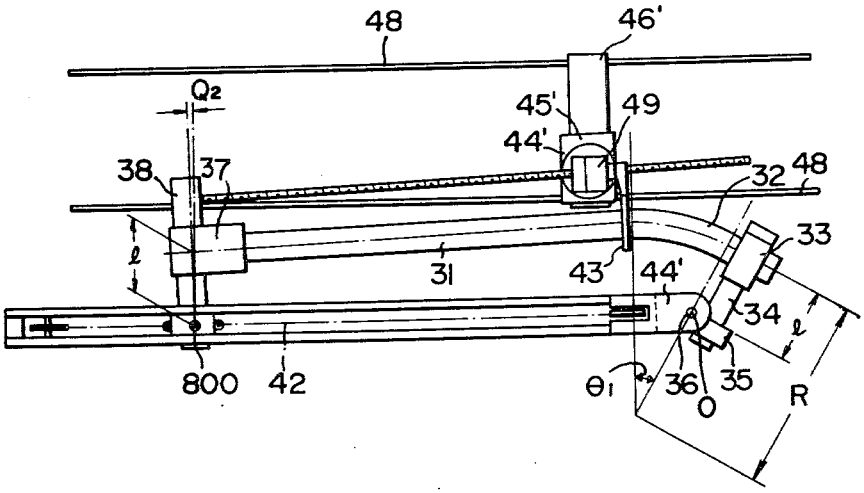

FIG. 15 is a plan view of an alternate embodiment of the present invention.

Figure 16:
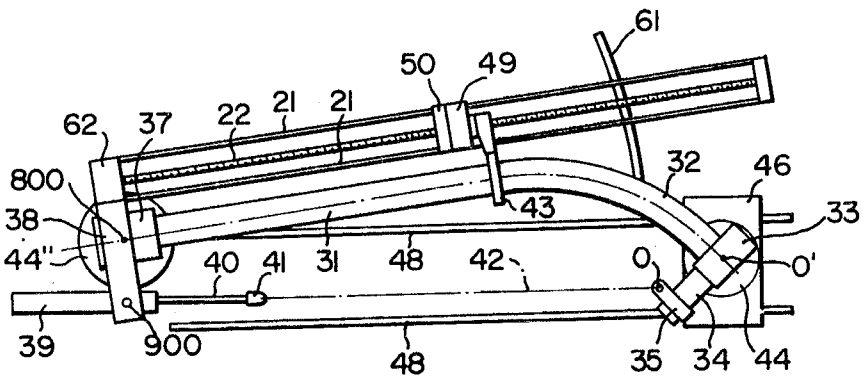

FIG. 16 is a plan view of an alternate embodiment of the present invention.

Figure 17:
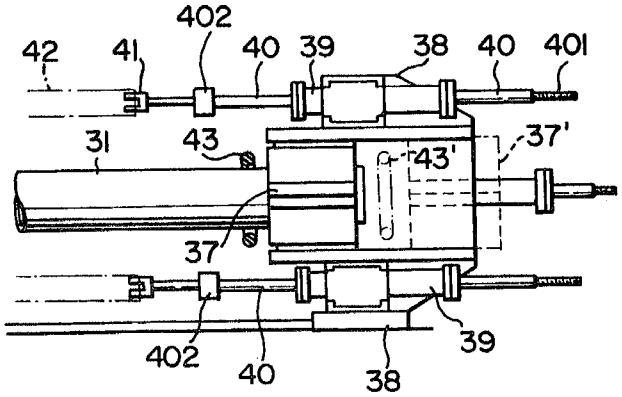

FIG. 17 is a plan view in partial phantom of a bender tail clamp.

Figure 18:
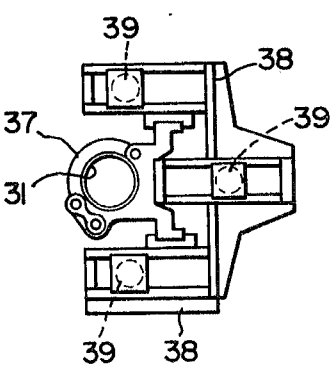

FIG. 18 is a side view in partial phantom of a bender tail clamp.

Figure 19:
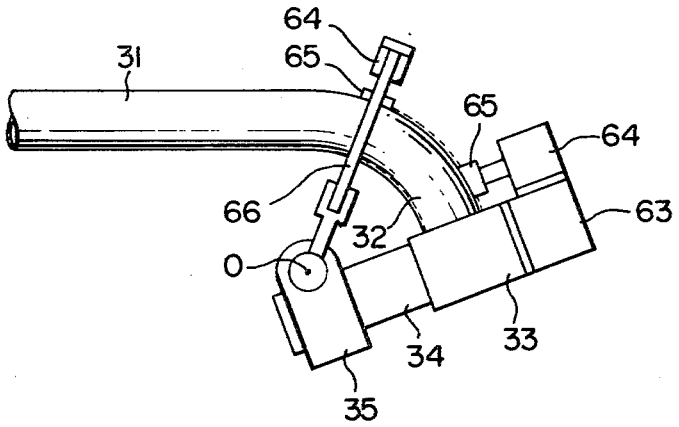

FIG. 19 is a plan view of an embodiment of the present invention including a device for preventing excess deflection during bending under large compressive forces.

Figure 20:
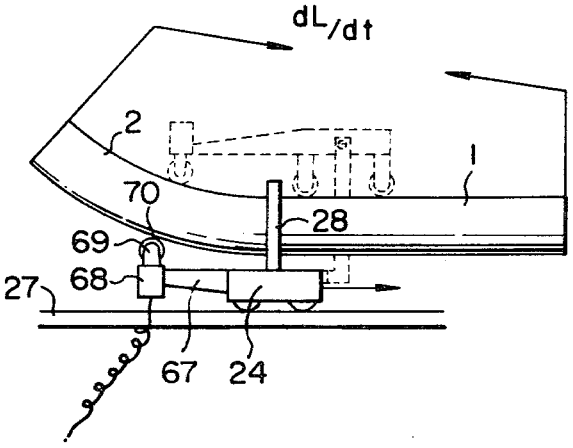

FIG. 20 is a side view of an embodiment of the present invention including a device for regulating bending radius.

DETAILED DESCRIPTION

Figure 1:
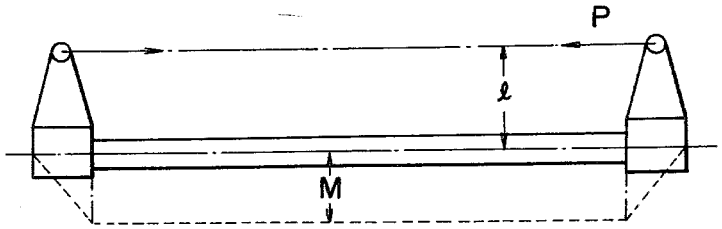
FIG. 1 is a side view of a clamped portion of elongated material to be bent.

Referring first to FIG. 1, a section of elongated material is shown clamped on either end, prior to bending. An arm coupled to the clamps, is employed to apply a bending force P. The bending force is chosen to be 60–80% of the force required to effect bending while the remaining 20–40% of the bending force is applied by a device to stimulate bending locally in the case of cold bending. This invention also embraces applying bending force with the transverse arm in the manner described above, while applying local heating by means of a heater to stimulate bending and to regulate the radius of bending.

It will be apparent that this invention eliminates the need for a strong frame, which is necessary for typical press bending. Accordingly, the apparatus of the present invention is light and compact. Furthermore, in cold bending, large bending moments within the elastic limit of the material are distributed over a portion of the elongated material to be bent, so that the supplementary moment necessary to effect bending is easily applied.

For instance, in steel, the elastic limit is about 82% of the plastic deformation resistance. Therefore, 80% or less of the yield point of the steel material may be applied as a main bending moment without causing any plastic deformation. A force of about 20% of the yield point of the material is enough to simulate bending. The use of such a main bending moment and a stimulating bending moment facilitates easy regulation of the bending radius. The device of the present invention has remarkable advantages for the bending of large heavy pipes, because the device for applying the main bending force is relatively light and compact. In addition, the stimulating device for applying the supplementary force is also relatively light and compact.

Figure 2:
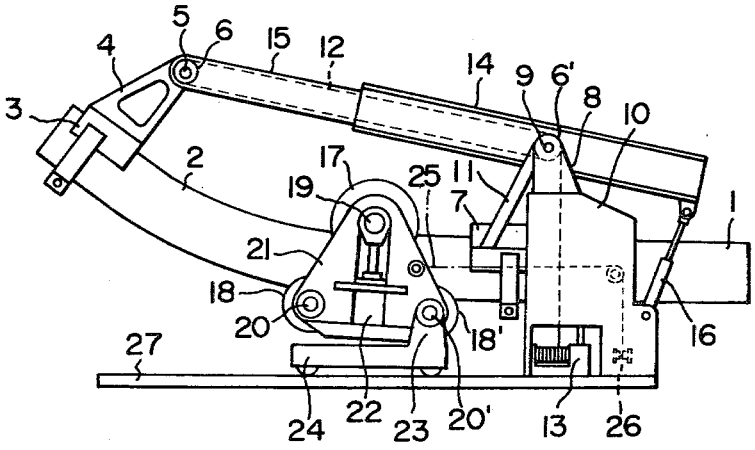
FIG. 2 is a side view of a pipe bender apparatus of an embodiment of the present invention, with a roller bender.
Figure 3:
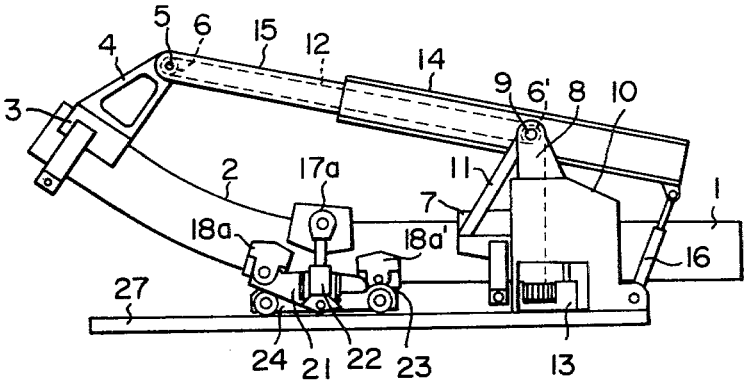
FIG. 3 is a side view of a pipe bender apparatus of an alternate embodiment of the present invention, with a press bender.

FIG. 2 shows an apparatus of an embodiment of the present invention for cold bending wherein the bending stimulator is a three roll bender. FIG. 3 shows an embodiment of the present invention wherein the bending stimulator is a press bender. Both bending stimulators are constructed to be freely movable to conform to the curve of the bent portion of the bending material and to exert a bending force provided by a hydraulic cylinder, screw, etc.

In FIGS. 2 and 3, like structures and features are identified by the same numerals. In these figures, an elongated metal material 1 includes a bent portion 2. A clamp 3 is employed to clamp a portion 3*a* of the elongated material adjacent to and on one end of the bent portion 2. An arm 4, transverse to the clamped portion 3*a* of the elongated material is attached to the clamp 3. A second clamp 7 is clamped to a portion 7*a* of the elongated material adjacent to the bent portion 2 at the other end thereof. An arm 8 is rigidly attached to the clamp 7, and is oriented perpendicular to the principal axis of the clamp portion 7*a* of the elongated material. The arm 8 is supported by a base frame 10. The arm 8 is maintained in a fixed position with respect to the base frame 10 while bending is undertaken. Advantageously, the arm 8 may be rendered slidable so that the arm may be lowered into the base frame when the bender is being transported. The member 11 is a reinforcement for facilitating the rigid connection of the clamp 7 and the arm 8.

Portions of the arms 4 and 8 displaced from the elongated material may be pivotally connected by a collapsable boom comprising the telescoping members 14 and 15. Pivotal connection points 5 and 9 may be drawn toward one another to exert the main bending force by pulleys 6 and 6′ having a cable 12 operatively connected therebetween. A winch 13 is employed to exert a force between the pivot points 5 and 9 to apply the main bending force. The distance between the pivot points 5 and 9 is gradually shortened as the bending proceeds. Advantageously, a hydraulic cylinder 16 may be provided for moving and supporting the collapsable boom relative to the base frame 10. The mechanism thus far described is employed to apply 60–80% of the required bending force. This portion of the mechanism is substantially identical in the embodiments of FIGS. 2, 3 and 4.

In the embodiment of FIG. 2, the supplementary bending force is provided by a roll bender. The roll bender includes a main roller 17 formed to fit the elongated material 1. Supporting rollers 18 and 18′ are provided, which support rollers are rotatably mounted on shafts 20 and 20′. A frame 21 supports the shafts 20 and 20′ and also supports a shaft 19 on which the main roller 17 is mounted. The shaft 19 is equipped with a set of screws or hydraulic cylinders 22, to render the shaft 19 vertically movable with respect to the supporting rollers 18 and 18′. The screws or hydraulic cylinders 22 are adapted to exert a secondary bending force, typically force 20–40% of the yield point of the elongated material. The bending radius of the material is determined by the amount of pressing down stroke applied by the main roller 17.

A bracket 23 is employed to support the roll bender frame 21 so as to be freely pivotal around the shaft 20′. A trolley 24 is employed to support the bracket 23 at one end. The trolley and roll bender are movable along a rail 27, the position of the trolley on the rail being determined by a cable 25 placed under tension by a winch 26. A motor (not shown) is mounted on the trolley 24, and is employed to move the trolley from right to left in the Figure after bending is finished.

Although the device described in connection with FIG. 2 provides excellent bending results, the device may be too expensive for some applications because of the weight of the main roller. Moreover, where a large bending radius is desired, intermittent bending in place of continuous bending is desirable. Under the foregoing circumstances, the apparatus of FIG. 3 may be more suitable.

In the embodiment of FIG. 3, the supplementary bending force is provided by a press bender. The press bender may include a bending dye 17*a* located in place of the main roller of the embodiment of FIG. 2. The press bender also includes bending shoes 18*a* and 18*a*′ which are located in the approximate place of the supporting rollers 18 and 18' of the embodiment of FIG. 2. A motor driven trolley 24 is employed to move the press bender from left to right along the rail 27. The trolley may be driven intermittently and bending performed while the trolley is stopped. Although the quality of the bend provided by the device by the embodiment of the present invention shown in FIG. 3 is inferior to that provided by the embodiment of FIG. 2, the bending dye is less expensive than the bending roller, and the use of the bending press permits the bending of coated pipes without substantial damage to the coating.

Figure 4:
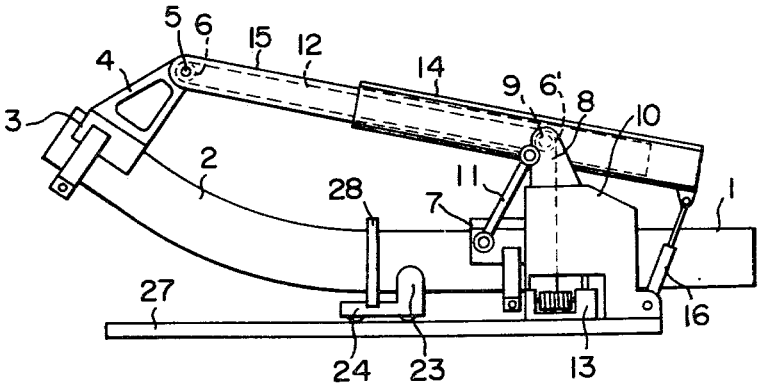
FIG. 4 is a side view of a pipe bender apparatus of an alternate embodiment of the present invention, with a traveling heating device.

FIG. 4 shows an alternate embodiment of the present invention adapted to perform hot bending. When very large steel pipes (e.g., 40 inches in diameter) are to be bent or when the relative bending radius is smaller than 18, hot bending becomes desirable.

In FIG. 4 like structures and features to those described in connection with FIGS. 2 and 3 are identified with the same numerals. The apparatus for applying the main bending force in FIG. 4 is substantially identical to that employed in the embodiments of FIGS. 2 and 3. However, the device for applying the supplementary bending force of FIGS. 2 and 3 is replaced in the embodiment of FIG. 4 by heating means 28, which, advantageously, may be a ring burner, induction coil or similar device. The heating means 28 is placed in surrounding relationship to the elongated material. The heating means 28 travels on a trolley 24 and is employed to heat the elongated material 1 in a narrow band. The narrow band of heating is moved gradually from left to right in the Figure by means of the motor driven trolly 24. It will be readily understood that while the bending force exerted by the arms 4 and 8 is distributed over the length of the portion 2 of the elongated material, bending can be performed in an arbitrary radius by controlling the moving speed of the heating means in a bending program including control of the force applied by the arms 4 and 8.

Because the device for applying the main bending force in FIGS. 2 and 3 and the device for applying the bending force in FIG. 4 are nearly identical, it is possible and desirable to provide three kinds of trolleys 24 each equipped with a different type of bending stimulator so that different bending stimulators are readily available to perform different types of bending operations.

The above described cold bending embodiments may be as little as 36% of the weight of known large scale field benders. It is thus easily transportable. Moreover the productivity of the roll bender employed in FIG. 2 is greatly increased by use as described in connection with the Figure.

It will be readily appreciated that the vertical arrangement of components shown in FIGS. 2 through 4 may be modified to provide a horizontal arrangement. This may be done by substituting a horizontally movable trolley for clamp 3 which performs essentially the same function as the collapsable boom. Naturally, the roll bender or press bender must be reoriented by 90°. Moreover the pulley and winch combination 13 may be replaced by a multiple screw, hydraulic cylinder or any other means for providing a force to draw the pivot points 5 and 9 together.

Figure 5:
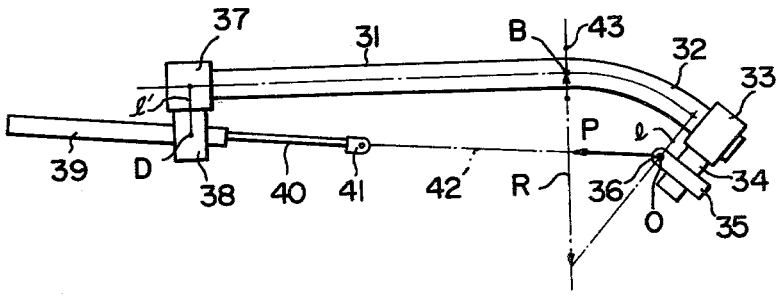
FIG. 5 is a plan view of a portion of a bender apparatus of an alternate embodiment of the present invention.

FIG. 5 is a schematic plan view of a portion of a bending apparatus which may be used to provide bends of small and large radius without substantial thinning or flattening of the bent pipe and without causing metallurgical defects which could result in stress corrosion. Moreover, the apparatus of FIG. 5 can be used to perform continuous uniform heat treating throughout the whole length of a pipe including not only the bent portions but also the straight portions.

In FIG. 5 the elongated metal material such as a piece of pipe 31 includes a bent portion 32. A clamp 33 is employed to clamp a portion **33*a* of the elongated material adjacent to the bent portion 32. As shown in the Figure, the portion 33*a* held by the clamp 33 is disposed away from a principal axis of an unbent portion of the elongated metal material 31. A bending arm 34 is rigidly attached to the clamp 33 and is pivotally attached for free pivoting about the axis O. Advantageously, the bending arm 34 may be attached to a bracket 35 which in turn is pivotally mounted on a shaft 36 aligned with the axis O. A clamp 37 is employed to clamp a portion 37*a* of the elongated material located on the other end of the portion of the elongated material 31 to be bent. The clamp 37 is, in turn, rigidly attached to a base frame or arm 38. A hydraulic cylinder 39 or similar pulling device having a piston rod 40 is fixed to the arms 38 and coupled by means of a cable 42 to the shaft 36. A heating means 43 is provided to heat the elongated material 31 in a narrow band. The operation of the embodiment shown in FIG. 5 will now be described with respect to the geometric locations, axis and distances noted in the Figure. The distance between the principal axis of the clamped portion 33*a* and axis O, at which the pulling force is exerted on the arm 34, is denoted by the letter L. The distance from the point D at which the pulling force is exerted on the arm 38 to the principal axis of the elongated material within the clamp 37** is designated by the letter L'. Finally, the bending radius is designated by the letter R.

A pulling force P exerted between points D and O is leveraged in accordance with the ratio of the bending radius to the lengths L and L'.

With continued reference to FIG. 5, the bending of the elongated material 31 is stimulated by the heating means 43 while the compression force P is exerted on the elongated material. The bending radius is controlled at will by controlling the ratio of the speed of movement of the heating means 43 along the elongated material 31 with respect to the pulling speed of the means providing the pulling force between the points D and O.

It is characteristic of the results obtained by the apparatus of FIG. 5 that the large compressive forces exerted prevent substantial wall thinning while the bending radius of the material may be easily controlled. Moreover, the large forces developed in the apparatus are balanced in a loop comprising the base frame 38, the clamp 37, the elongated material 31, the clamp 33, the bending arm 34, the bracket 35, the cable 42 and the piston rod 41. Large forces are not exerted on any other parts in the system. Accordingly, any forces exerted on the apparatus which is not in the above described loop will be no more than the mere weight of the component and the elongated material 31 which force is typically very small compared to the pulling or compressing force in the loop. The concept of balancing large bending forces in a loop is shown generally by U.S. Pat. No. 4,056,960 in the case where L'=R. But the device disclosed therein is limited to operation in the case where the bending radius is equal to the distance from a center of rotation of the bending arm to the principal axis of the elongated material being bent. The present invention is distinguishable from that disclosed in the aforementioned U.S. Patent in the defending radius can be freely changed without changing the effective radius of the bending arm. Other differences will become apparent in the following description.

The embodiment of FIG. 5 has been described in terms of relative movement of the component parts of the loop. Naturally, some part of the apparatus should be fixed to the base or the ground, but the choice of which part is to be fixed must depend on the purpose for which the bender is to be employed. It will be understood, however, that no matter which part of the apparatus is chosen to be fixed to the ground, no heavy foundation will be required because no excessive forces are exerted outside the loop.

Figure 6:
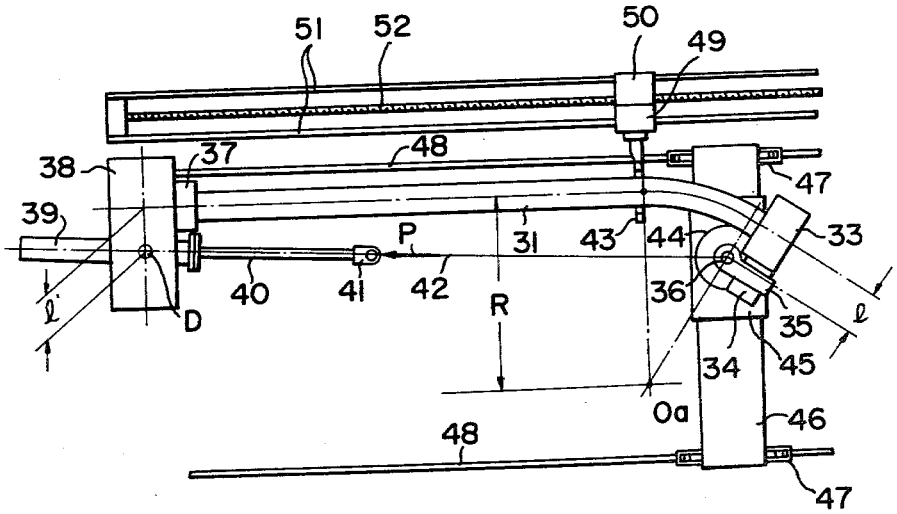
FIG. 6 is a plan view of a bender apparatus of an alternate embodiment of the present invention.

Referring now to FIG. 6, similar structure and features of the embodiment of FIG. 5 are identified with the same numerals. In the apparatus of FIG. 6 the clamp 37 and the base frame 38 have been fixed with respect to the ground. The clamp 33, the bending arm 34 and the bracket 35 are pivotally mounted to move freely in a bending plane parallel to the plane of FIG. 6. To facilitate this motion a table 44 is provided on which the bracket 35 is pivoted on a shaft 36. The table 44 is so constructed that it may slide vertically in the Figure on a trolley 46. The trolley 46 is movable in a direction parallel to the principal axis of the unbent portion of the elongated material 31, and the slide table is movable in a direction transverse to the principal axis of the unbent portion of the elongated material 31.

An annular heating means 43 on heat source such as a high frequency transformer 49, is mounted on a second trolley 50, the second trolley being movable in a direction parallel to the principle axis of the unbent portion of the elongated material 31. The second trolley 50 is constrained to move along the rails 51 under the power of a screw 52, it being understood that a chain, rack or other drive means may be substituted for the screw 52.

The cylinder 39 providing the bending force, and the driving device for the heating means such as screw 52 should be variably controllable, so that the heating means may be moved at a selected speed in either direction along the rails 51.

Figure 7:
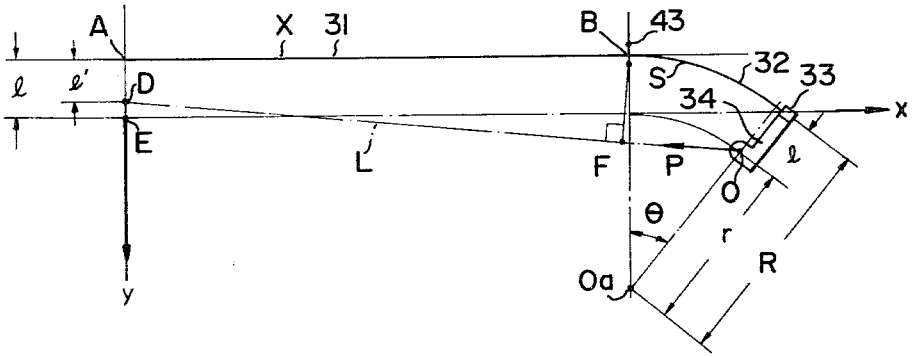
FIG. 7 is a diagrammatical view illustrating the operation of the embodiment of FIG. 6.

The basic construction of the apparatus of the embodiment of FIG. 6 is shown diagrammatically in FIG. 7 in order to describe the controlling of the bending radius by means of the apparatus.

In FIG. 7 the line AB represents the principal axis of the unbent portion of the elongated material 31. The arc BC represents the principal axis of the bent portion 32. The length of the line AB is represented by the letter X and the length of the arc BC is represented by the letter S. For a circular arc with a center Oa the arc S subtends the angle $\theta$. Finally, the distance between the point O and the principal axis of the clamp portion of the elongated material (line OC) has a length L'. Although the point O is not necessarily located on the line OaC, it is more convenient to take the point O as being on the line OaC to simplify the following explanation.

The line ADE is perpendicular to line AB, the line ADE having a length L'. The line segment AD has a length L''.

To effect bending, the tension P is applied between the points D and O. Point B is a bending point which is heated locally by the heater 43.

The following relationships are indicated by the Figure. BOa=COa=R, R—r=L'. For the purposes of discussion, point E will be treated as the origin of a rectalinear x-y coordinate system, wherein the x axis is parallel to line AB and the y axis is parallel to line AE. If the coordinates of point O are represented by (xo, yo), then:

$$x_o = X + r\sin\theta \quad y_o = r(1-\cos\theta).$$

The coordinates of point D are represented by ($x_O$, $y_O$) and $$x_D = 0 \quad y_D = L'' - L'.$$

Where L is the distance between point D and point O $$L = \sqrt{(X + r\sin\theta)^2 - [r(1-\cos\theta) + L' - L'']^2} \qquad (1)$$

If the length Ab=Xo when $\theta=0$ at the start of bending, then $$X = Xo - (Wm/W)S = Xo - (Wm/W)R \qquad (2)$$

where $\theta$ is the bending angle in radians, W is original wall thickness of the elongated material, and Wm is the mean wall thickness of the elongated material after bending. When the relative bending radius is large, the ratio Wm/W is very nearly, equal to 1, but when the relative bending radius is very small Wm/W becomes too large to be neglected. This ratio can theoretically be calculated or actually measured, and especially at the start of bending it can be easily measured, so that the ratio Wm/W may be treated as a known value. Then from formulas (1) and (2), the length L can be expressed as a function of $\theta$, from which expression the pulling speed relation of bending angle $dL/d\theta$ can be calculated easily. When the moving speed of heating means is given as dx/dt, then the pulling speed will be $$dL/dt = (dL/d\theta)(d\theta/dt),$$

$d\theta/dt$ being determined by differentiating formula (2).

It will be clear from the foregoing that the bending radius can be kept constanct by controlling dL/dt as a function of angle $\theta$ or time.

The above method for control is used as a basis for the methods of this invention.

In a second method performable with the disclosed apparatus, bending is started at a predetermined pulling speed and after the bending of very small angle, a feed back control is applied to regulate the bending radius. The method involves the controlling of the linear speed dx/dt and angular speed $d\theta/dt$ individually according to following formula:

$$R = (S/\theta) = (ds/d\theta) = (ds/dt)/(d\theta/dt) \qquad (3)$$

and if a circular bend with a uniform radius is desired, the method only requires the measurement of S and $\theta$ in incremental time intervals and to regulate ds/dt and $d\theta/dt$ so as to let the value of formula (3) be constant. This second method based on feed back control can be applied to correct said first method based on program control.

Such dual control is effective when the relative bending radius is so large that deflection of elongated material 31,32 is too large to be neglected. It is true that to prepare a precise program of dL/dt including the effect of said deflection is possible, but such programming is fairly complicated and would not be practical compared to the above dual control.

In the second method, if the absolute values of S and $\theta$ are precisely known, highly accurate bends can be performed. For instance in 180 degree bending, the error of bending radius would be less than $\frac{1}{3}$ of the error of S because $R=S/\theta$.

In a third method, the positon coordinates of a reference point on the slide table 45, the bending arm 34, or bracket 35 are programmed and the coordinates of the point are measured while bending is performed. Then, $dx/dt$ and $dL/dt$ are controlled so as to let the measured value coincide with the programmed value.

In such case, when the program is determined relating to the angle $\theta$, control is free from the ratio Wm/W, but the program must include deflections of the machine and the elongated material which are very hard to calculate. But in case of short radius bending it will be sufficiently accurate to add the effect of the deflection at the start of bending. In cases where the relative bending radius is so small that Wm/W becomes very large, the third method would be an effective way to correct the program of the first method.

In the following discussion, two basic methods effective to maintain the ratio Wm/W constant are explained.

In the first method, two pulling forces $P_1$ and $P_2$ are applied so that $P_1+P_2$ is kept constant by means of regulating the ratio $P_1/P_2$.

Figure 8B:
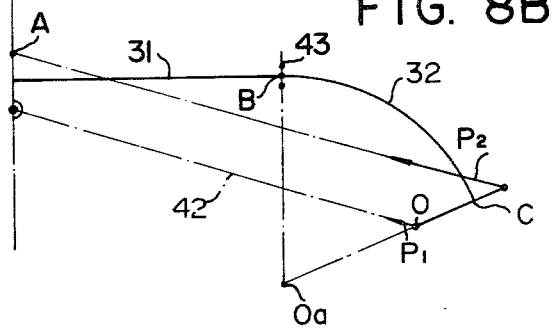

In FIG. 8A, the letters A, B, C, L' and L'' indicates the same features as in FIG. 7. A secondary pulling means is installed for the elongated material 31. The location of the secondary pulling means is not limited to the case of FIG. 8 and may be freely selected depending on need. At first when bending is started, secondary pulling force $P_2$ need not be exerted, but only main pulling force $P_1$ should be exerted. After the bending has proceeded to some extent and pulling force $P_1$ is reduced, the secondary pulling force $P_2$ should be exerted gradually controlling said ratio $P_1/P_2$ to keep horizontal component $P_1+P_2$ constant.

Another method to keep compressive force constant is to attach some proper guide to keep the pulling force substantially parallel to the elongated material to be bent. A schematic diagram of such a device is shown in FIG. 9A. In the Figure, L'=L'' and a freely changeable fan type guide 53 with an effective radius r equal to $R-L'$ is fixed to the arm 34 having its center coincide with a point that should be a center of bending.

Figure 9B:
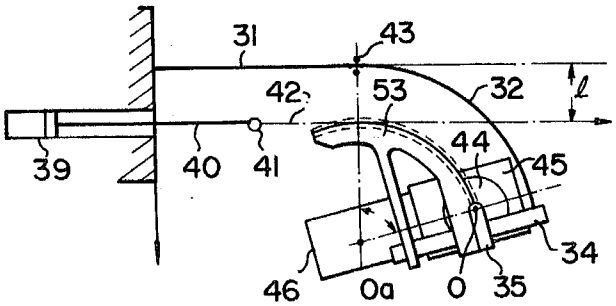

It will be apparent that, in the embodiment of FIGS. 9A and B, the pulling force would be kept parallel to the elongated material to be bent so that pulling force P would be kept constant while bending proceeds as shown in FIG. 9B. An expression for the pulling force P is:

$$P=M/L'$$

where L' is constant and M is a constant moment for bending exerted on the heated zone of the elongated material to be bent. Of course, the fan type guide must be changed to change the bending radius. However, if the pulling speed dL/dt is maintained equal to the moving speed of the heater 43 (dx/dt), the bending radius will be kept constant.

Figure 10B:
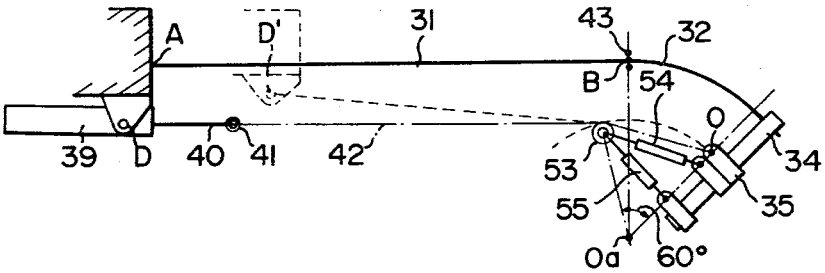
Figure 10C:
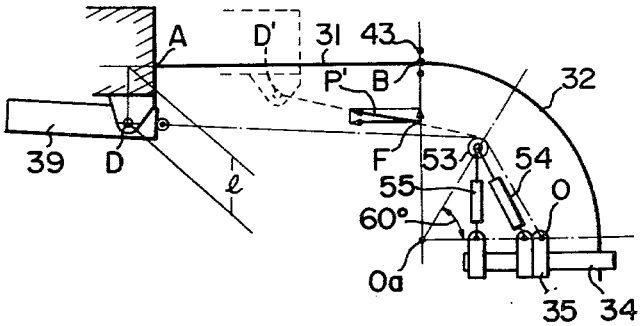

FIG. 10 shows a bending apparatus similar to that described in connection with FIGS. 9A and B except that a roller guide 53 has been substituted for the fan guide 53 of FIGS. 9A and B. The roller guide 53 extends from the bending arm 34 and is rendered adjustable by jacks 54 and 55 to produce an effective radius equal to that of the fan guide, namely r.

Optimally, the roller guide 53 is arranged for movement about the radius passing through the point Oa inclined at an angle of about 60° with respect to the bending arm as shown in FIGS. 10B and C. It will be clear from the figures, that in order to keep the deviation of the pulling force small, the location of point D, where the pulling force is exerted, should be displaced to a point D'. The location of point D' should be selected so that the distance BF (in which F is the point of intersection of the radius $B-Oa$ and pulling line connected to D') is equal to L'. If the pulling force is directed in the above-mentioned manner, the longitudinal compressive force at the end of 90° of bending will be equal to $M/L'$. In addition, variations in the compressive force during bending are minimized.

FIG. 11 is a schematic plan view of an alternate embodiment of the present invention having two roller guides 53 and 53'. The two roller guides are provided in order to minimize deviation in the compressive force during bending. As in FIG. 10, the location of the guide is made variable in order to correspond to changes in the bending radius.

FIGS. 12 ad 13 show a device by which the effective radius of fan guides 53, such as employed in the embodiments of FIGS. 9A and B, may be made variable, to vary the radius of bending. In the Figures, a four piece fan plate 56 has its center located so it coincides with a center of bending, namely point Oa. Slots 57 in the fan plate are arranged radially and receive square nuts 58. Pairs of the square nuts 58 are slidable within the slots and are connected together by means of pins 59. By adjusting the positions of the square nuts and connected pins, the effective radius of the fan guide may be varied.

FIG. 14 shows an embodiment of the present invention in which two kinds of devices are employed to maintain the compressive force constant. Specifically, FIG. 14 is a plan view of an embodiment of the present invention employing a secondary pulling device and a fan guide therefore. The embodiment of FIG. 14 permits accurate control of the bending while avoiding the need to change guides. The piston and chain arrangement 39, 40, 41 and 42 acts as a secondary pulling means, while the drive and the screw 39' and 40' acts as the main or primary pulling means. It will be noted from the Figure that the secondary pulling means 39–42 is kept parallel to the unbent portion of the elongated material by the fan guide 53, the pulling screw 40' being located parallel to the secondary pulling means.

The advantages of such a construction is that it requires no variable or various radius fan guide even when the desired relative bending radius is small. The procedure for controlling the mechanism shown in FIG. 14 is relatively simple and requires only that the speed of the heating zone (dx/dt) be equal to the pulling speed of the main pulling means in order to keep the bending radius constant. Moreover, the compressive force can be maintained constant by varying the ratio of $P_1$ (the primary pulling force) with respect to $P_2$ (the secondary pulling force).

Furthermore, it is possible to perform bending in a very large radius by use of the apparatus of FIG. 14 by varying the rate of pulling as compared to the movement of the heating source 43 so that the pulling rate (dL/dt) is very small compared to the rate of movement of the heating source (dx/dt). In this case variations in the compressive force would result, but their effect would be neglible because wall thinning is small when pipe is bent to a large bending radius.

The apparatus described in connection with FIG. 14 is arranged so that the frame 38 is fixed to the ground and the table 44 which supports the bending arm 34 is movable with respect thereto. Alternatively, however, the table 44 may be fixed to the earth and the base frame 38 may be made movable on a rail such as rail 48. In this case the heater 43, heat source 49, and trolley 50 may also be fixed to the earth.

The apparatus in FIG. 14 is configured so that the means for applying a bending force is operated independently of the means for moving the heating source 43 so that bending may be accomplished wherein the bending radius at the start of the bending is varied gradually from very larger to smaller radius to prevent swelling constriction of the pipe. And at the end of bending, radius may be advantageously varied from smaller to very larger to get smooth bend.

Such variation of bending radius at the start and the end of bending to get bend smooth is applicable to other embodiments because of dual driving system.

Referring now to FIG. 15, an apparatus is shown, which, unlike the apparatus of FIG. 6 has a center of rotation of the bending arm fixed to the earth. A point 800 on the arm 38 may be made movable toward the center O of rotation of the bending arm 34. A chain pulling device 42 is operative to draw the point 800 toward the center O of rotation of the arm 34.

With continued reference to FIG. 15, the arm 38 may be pivotal about the point 800. If the angle of rotation of the arm 38 is $\theta_2$ and the angle of rotation of the bending 34 is $\theta_1$ then the total bending angle $\theta$ is equal to the sum of $\theta_1$, $\theta_2$, neglecting deflection of the elongated material 31.

In the apparatus of FIG. 15, the heater 43, the heat source 49, and the table 50 are supported on the trolley 46'. In the alternative, the heater 43 may be supported by a crane or the like rather than being supported directly on the earth.

FIG. 16 is a plan view of an embodiment of the present invention in which the leading clamp 33 is pivotal about an axis passing through the principle axis of the elongated material at the point O'. The pulling device operates at point 0. The table 46 on which the clamp 33 is pivotally mounted is arranged so that it may be moved horizontally in the Figure towards the tail end of the elongated material along a rail 48. The tail clamp 37 is fixed on a pivotal table 44''. The pulling device 39 is pivotally attached to the tail arm 38 at pivot point 900. Rails 21 are installed in the table 44'' and are supported by guide rails 61 so as to let them turn along with the table 44'' as a single unit. Although in the Figure the pivoting axis 0' and 800 for tables 44 and 44'', respectively, are shown to be located on the principle axis of the elongated material, this is not a necessary condition to the operation of the device. A driving means 62 may be provided to regulate the rotation of the screw 22 to vary the position of the heating means 43.

In the case that internal heating or cooling of a pipe being bent is required, the embodiment of FIG. 6 would be preferred over the embodiment of FIGS. 15 and 16, since the internal heating or cooling means may be moved in a simple linear motion in the embodiment of FIG. 6 by means of a mandrel.

In the case of bending vary large sized pipe, the weight of the tail clamp arm or base frame and the pulling means (hydraulic cylinders) will amount to about 40% of the total weight of the machine. In such a case it is advantageous to fix these parts to the earth. Furthermore, in an apparatus where these tail parts are fixed, a rotary clamp can advantageously be provided for use in making three dimensional bends.

FIGS. 17 and 18 show a tail clamp 37 which may be used with embodiments of the present invention. The tail clamp is so arranged to make it possible to preform heat treating over the entire length of the unbent portion of the elongated material. During bending, the tail clamp 37 is fixed in the position shown by the solid lines in FIG. 17. When bending is completed the tail clamp may be brought into the location shown by the dotted line 37' thereby permitting the heating means 43 to be backed over the end of the elongated material to the location shown by the dotted lines 43'.

Also shown in the Figure is a pulling mechanism which here comprises a hydraulic cylinder having a piston rod 40 which takes the form of a sleeve. The long threaded rod 41 may be received by a threaded hole in a screw block 402. It will be readily understood that the screw and screw block may be manipulated to adjust the effective length of the screw and the action of the pulling mechanism.

FIG. 19 shows an apparatus for preventing excess deflection of the bent portion 32 of the elongated material, which otherwise can take place when bending proceeds beyond 45° under large compressive forces. A hydraulic cylinder 64 is mounted on a bracket 63 which in turn is fixed at a suitable location on the clamp 33. The hydraulic cylinder 64 is provided to exert a radially inward force on the bent portion 32. The force from the hydraulic cylinder 64 is exerted on liner 65 having suitably curved surfaces or lined with flexible material to prevent permanent deformation of the bent portion 32 beyond its elastic limit. A supplementary stay 66 is pivotal about the center of rotation of the bending arm, namely, 0. In the case that bending in the range of 180° is to be performed, a plurality of supplementary stays 66 may be provided.

In order to determine the length S of the bent portion 32, a roller sensor may be placed in contact with the elongated material. Alternatively, the displacement of the bent portion 32 may be measured optically or by means of a scale inserted in hollow elongated materials.

FIG. 20 shows a side view of an apparatus for regulating the radius of bending. A lever 67 projects from a top side of the trolley 24 which supports the heating means 28. A displacement detector 68 is attached to the lever and coupled to a roller 70. The roller rolls on an outside surface of the bent portion 32 in order to detect deviations from the desired bending radius.

In order to obtain a uniform bending radius, the speed of the driving means and the heater 28 are varied in order that the output from the detector 68 remains constant. Alternatively, the lever, roller and detector may be located on the inside surface of the bent portion 32 as shown by the dotted lines in the Figure. This second arrangement is preferred because it provides greater accuracy and because the wall thickness of the inside of the bent portion is thicker than the outside with the result that less flattening of the material occurs.

As discussed above, the method and apparatus of the present invention makes it possible to prevent wall thinning by exerting very large compressive forces during bending. The invention also permits very large radius bending to be performed without changing the effective length of a bending arm which, in the embodiments of the present invention, may be very short. The invention also makes possible the use of uniform heat treatment upon the entire length of the elongated material.

The teachings of the invention may be applied to a bender for performing plural, three dimensional bending in short radii. It may also be employed for bending carbon steel pipes and also stainless steel pipes used, for example, in nuclear power plants. Finally, the methods of the present invention may be used for bending heat proof steel pipes, for example, those containing in the neighborhood of 4% chromium.

The methods and apparatus of the present invention are particularly well adapted for bending Austenite stainless steel pipes because, thermal brittling, which is often caused by traces of adherring aluminum or copper, is prevented by exerting a large compressive force on the heated zone of the pipe. The exerting of this large compressive force minimizes the tensile stress at the outside of the bending. Wall thinning and flattening are prevented as well and further residual stress on the inside surface of the bend is reduced or rendered compressive by means of inside cooling to prevent stress corrosion. At the same time solution heat treatment is performed naturally by providing a large cooling rate. Thus, the present invention provides a method and apparatus for bending pipes in a mechanically and metallurgically acceptable manner at a low cost.

The bender apparatus embodiments of the present invention are useful for bending heat proof alloy steel pipes including four or more percent of chromium. This is so because quenching caused by rapid cooling while bending may be prevented by keeping the heating temperatures lower than the critical point of modification and higher than a temperature which is 100° below said critical point. Furthermore, impact value and hardness after bending are maintained nearly equal to that of the original unbent material. At the same time, the compressive force not only prevents wall thinning but also prevents intergranular loosening, because the compressive force minimizes tensile stress at the outside radius of bending, so that high quality bends of alloy steel are provided at lower cost.

The principles, preferred embodiments and modes of operation of the present invention have been described in the foregoing specification. The invention which is intended to be protected is not, however, to be construed as limited to the particular forms disclosed, since these are to be regarded as illustrative rather than restrictive. Variations and changes may be made by those skilled in the art without departing from the spirit and scope of the present invention.

We claim:

1. A method of bending elongated material having a principal axis, comprising the steps of:

clamping a first portion of the elongated material with a clamp having an arm extending normal to the principle axis of the elongated material;

clamping a second portion of the elongated material with a clamp having an arm extending normal to the principle axis of the elongated material, wherein a portion of the elongated material to be bent is located between said first and second clamped portions;

applying a force to the arms of the clamps by pulling said arms toward each other along a line which inclines with respect to the principal axis of the portion of the elongated material to be bent, said force being applied at a location on each arm displaced from the principle axis of the elongated material; and stimulating bending in a zone within the portion of the elongated material to be bent, said zone moving along the elongated material and moving with respect to said locations, whereby said locations on the arms move toward each other as the material is bent.

2. The method of claim 1 wherein bending is stimulated by moving roller bender along the principle axis of the elongated material as bending proceeds.

3. The method of claim 1 wherein bending is stimulated by moving a press bender along the principle axis of the elongated material as bending proceeds.

4. The method of claim 1 wherein bending is stimulated by a device for locally heating the elongated material, which device is moved along the principle axis of the elongated material as bending proceeds.

5. An apparatus for bending elongated material having a principal axis, comprising:

a clamp for engaging a first portion of the material;

a bending arm attached to said clamp and extending away from the principle axis of the elongated material;

means for engaging a second portion of the material, wherein a portion of the elongated material to be bent is located between said first and second portions of the elongated material;

means connected between said engaging means and a location on said bending arm displaced from the principle axis of the elongated material for exerting a bending moment on the portion of the elongated material to be bent by pulling said engaging means and the location on said bending arm toward each other along a line which inclines with respect to the principal axis of the portion of the elongated material to be bent, said bending moment being less than the elastic limit of the portion of the elongated material between said engaging means and said clamp; and, means for stimulating bending of a selected local portion of the elongated material between said engaging means and said clamp, as bending proceeds.

6. The apparatus of claim 5 further comprising means for moving said stimulating means along the principal axis of the portion of the elongated material to be bent, said stimulation means moving relative to the location on said bending arm.

7. The apparatus of claim 6 wherein said stimulating means is a roller bender, for applying a bending moment to the elongated material, which, in combination with the bending moment of said bending moment exerting means, exceeds the elastic limit of the elongated material to be bent.

8. The apparatus of claim 6 wherein said stimulating means is a press bender for applying a bending moment to the elongated material, which in combination with the bending moment of said bending moment exerting means, exceeds the elastic limit of the elongated material to be bent.

9. The apparatus of claim 6 wherein said stimulating means is a means for locally heating the portion of the elongated material to be bent, to thereby selectively reduce the elastic limit of the elongated material.

10. A method for hot bending elongated metal material having a principal axis, comprising the steps of:

applying a compressive bending moment to a heated zone by:

clamping a first portion of the elongated material with a clamp having an arm extending normal to the principle axis of the elongated material;

clamping a second portion of the elongated material with a clamp having an arm extending normal to the principle axis of the elongated material, wherein a portion of the elongated material to be bent is located between said first and second clamped portions;

applying a force to the arms of the clamps by pulling said arms toward each other along a line which inclines with respect to the principal axis of the portion of the elongated material to be bent, said force being applied at a location on each arm displaced from the principle axis of the elongated material, heating the elongated material in a narrow zone with a heater; and moving the heater relative to the locations on the arms, along the principal axis of the elongated material;

whereby said locations on the arms move toward each other at a selected pulling speed as bending proceeds.

11. The method of claim 10 further comprising the steps of controlling the moving speed of the heater relative to the elongated material and controlling the pulling speed, in accordance with predetermined program.

12. The method of claim 10 further comprising the steps of measuring the length of the bent portion of the elongated material S and angle $\theta$ of relative rotation of the clamped ends of the elongated material and controlling the moving speed of the heater and the pulling speed so that $S/\theta$=the bending radius R.

13. The method of claim 12 further comprising the step of correcting the predetermined program by controlling the speed of the heater and the pulling speed so that $S/\theta$=the bending radius R.

14. The method of claim 10 comprising the steps of selecting a reference point on one of the arms, determining the coordinates of the reference point as a function of the bending angle $\theta$ for the desired bend, measuring the coordinates of the reference point as bending proceeds, and controlling the moving speed of the heater and the pulling speed to minimize the difference between measured value and the determined value of coordinates of the reference point.

15. The method of claim 10 wherein one of the arms transverses the principle axis of the elongated material and further comprising the step applying a secondary pulling force to a location on one of arms on the opposite or the same side of the location to which the primary force is exerted so as to exert a desired compressive force on the elongated material.

16. The method of claim 15 wherein the secondary pulling force is applied by a flexible elongated member pulled substantially parallel to the unbent portion of the elongated material, said member being engaged by a fan guide having an effective radius which ratio to the bending radius is selected properly, fan guide being concentric with the center of bending.

17. The method of claim 10 wherein the primary pulling force is applied by a flexible elongated member pulled substantially parallel to the unbent portion of the elongated material, said member being engaged by a fan guide having an effective radius which ratio to the bending radius is selected properly, fan guide being concentric with the center of bending.

18. The methods of claim 16 or 17 wherein the effective radius of the fan guide is selectively changeable.

19. An apparatus for bending elongated material having a principal axis comprising:

a clamp for engaging a first portion of the material;

a bending arm attached to said clamp and extending away from the principle axis of the elongated material;

means for engaging a second portion of the material, wherein a portion of the elongated material to be bent is located between said first and second portions of the elongated material, said bending arm being freely pivotably mounted to a table which is freely moveable in the plane of the bend;

means for locally heating the elongated material;

means for moving said heating means along said principal axis of said portion of the elongated material to be bent;

primary pulling means, for pulling the location on said bending arm toward said engaging means, said pulling means being connected between said engaging means and a location on said bending arm displaced a distance from the principal axis of the elongated material, said distance being less than a bending radius R said pulling means exerting a bending stress on the material which is less than elastic limit, and, means for controlling the ratio of the pulling speed of said primary pulling means to the speed of movement of the heating means to thereby control the bending radius R.

20. The apparatus of claim 19 in which the controlling means operates in accordance with a predetermined program.

21. The apparatus claim 19 further comprising means for measuring a length S of the bent portion of the elongated material and an angle of rotation $\theta$; a means for calculating a ratio of the length S to the rotating angle $\theta$, namely $S/\theta$; and means for controlling the ratio of the pulling speed to the time rate of change of $\theta$, namely $d\theta/dt$, responsive to the difference between said calculated value and a preset value.

22. The apparatus of claim 19, further comprising means for detecting the coordinates in the bending plane of a reference point on the bending arm.

23. The apparatus of claim 19, further comprising a secondary pulling means for exerting compressive force on the elongated material to be bent and a controlling means for regulating the ratio of the primary pulling force to the secondary pulling force.

24. The apparatus of claim 23 further comprising a fan guide on the bending arm, for maintaining the secondary pulling means parallel to the unbent portion of a metal elongate material.

25. The apparatus of claim 24 wherein said fan guide has a variable effective radius.

26. An apparatus for bending an elongated metal material comprising a first clamp which clamps a first portion of said elongated material, a first arm which is freely pivotal around an axis perpendicular to the plane of bending, said first clamp being fixed on said arm, a heating means for heating said elongated material, a second arm freely pivotal within a certain range having said second clamp being fixed on said arm, a primary means for exerting a pulling force between points on the first and second arms said points being displaced from the axis of the elongated material within the respective clamps, a trolley which is linearly mobile in a direction generally parallel to the force exerted by said pulling means, said second arm being supported on said trolley, driving means for driving said pulling means to perform bending so that the first and second portions have an angular velocity with respect to each other of $d\theta/dt$, $d\theta/dt$ being controllable, means for supporting and guiding the heating means so that the heating means moves in a longitudinal direction along said elongated material at a programmed velocity dx/dt and a control means for regulating the ratio of said dx/dt to $d\theta/dt$ to obtain the desired bending radius.

27. The apparatus of claim 26 further comprising controlling means for regulating dx/dt and a speed with which the first and second arms are pulled together so as to let them follow a program.

28. The apparatus of claim 26 further comprising means for measuring a length S of the bent portion of the elongated metal material and the angle of the bend $\theta$, a means for calculating the ratio of said length S to the angle $\theta$of the bend, namely $S/\theta$ and means for regulating the ratio of dx/dt to $d\theta/dt$ in accordance with difference between said calculated value of $S/\theta$ and a desired value.

29. The apparatus of claim 26 further comprising a secondary pulling means for exerting a compressive force on the elongated material, and a control means for regulating the ratio of the primary pulling force and the force exerted by the secondary pulling means.

30. The apparatus of claim 29 which includes a fan type guide or a set of proper number of projection type guides, with which the force exerted by the secondary pulling means is kept parallel to the unbent portion of the elongated material.

31. The apparatus of claim 26 further comprising a plurality of projection guides on one of said arms, having a variable effective radius.

32. An apparatus for bending elongated metal material comprising a tail clamp which clamps said elongated material at the tail portion thereof, an arm which is freely pivotal within a certain range around a point fixed on a plane of bending, having said tail clamp fixed on it, a heating means for heating said elongated material in a narrow band, a head clamp which clamps said elongated material at the head portion of said elongated material, a freely pivotable bending arm on which said head clamp is fixed, a pulling means for exerting a primary pulling force between points on said arms displaced from the axis of said elongated material within each clamp, a trolley which is mobile in a direction nearly parallel to said pulling means, said bending arm being pivotably mounted on said trolley, driving means which draws said pulling means to perform bending having a controllable bending angular velocity $d\theta/dt$, a means for supporting and guiding said heating means so as to move said heating means in a longitudinal direction along said elongated material at a programmed velocity dx/dt, and a control means for regulating the ratio of said dx/dt to $d\theta/dt$ to obtain the desired bending radius.

33. The apparatus of claim 32 further comprising means for controlling dx/dt to $d\theta/dt$ so as to let them follow a program.

34. The apparatus of claim 33 further comprising means to measure a length S of bent portion of the elongated material and the angle of bending $\theta$, means for calculating a ratio of said length S to bending angle $\theta$, namely $S/\theta$, and a means for regulating the ratio of dx/dt to $d\theta/dt$ responsive to the difference between said calculated valve of $S/\theta$ and its desired value.

35. The apparatus of claim 33 further comprising secondary pulling means for exerting a compressive force on the elongated material to be bent, and a control means for regulating the ratio of the primary pulling force of the secondary pulling force.

36. The apparatus of claim 35 further comprising a fan guide with which the secondary pulling means is kept parallel to the unbent portion of the elongated material.

37. The apparatus of claim 36 wherein the fan guide is located on the bending arm, the fan guide having a variable effective radius.

38. The apparatus of claim 33 wherein the tail clamp normally fixed when bending is performed, and selectively, slidably moveable to permit heat treatment of the clamped tail portion of the elongated material.

* * * * *